US006830090B2

(12) United States Patent
Foster

(10) Patent No.: US 6,830,090 B2
(45) Date of Patent: Dec. 14, 2004

(54) POLISHING PAD INSTALLATION TOOL

(75) Inventor: Bernard Foster, Elkton, MD (US)

(73) Assignee: Rohm and Haas Electronic Materials CMP Holdings, Inc., Wilmington, DE (US)

( * ) Notice: Subject to any disclaimer, the term of this patent is extended or adjusted under 35 U.S.C. 154(b) by 474 days.

(21) Appl. No.: 10/005,268

(22) Filed: Dec. 4, 2001

(65) Prior Publication Data

US 2002/0081958 A1 Jun. 27, 2002

Related U.S. Application Data

(60) Provisional application No. 60/257,076, filed on Dec. 21, 2000.

(51) Int. Cl.[7] ..... B30B 15/00

(52) U.S. Cl. ..... 156/581; 156/228; 156/580

(58) Field of Search ..... 156/228, 290, 156/538, 539, 556, 580, 581, 583.1, 583.3

(56) References Cited

U.S. PATENT DOCUMENTS 4,310,376 A * 1/1982 Ebina et al. ..... 156/499
4,875,966 A * 10/1989 Perko ..... 156/580
5,098,508 A * 3/1992 Mattil ..... 156/363
5,527,421 A * 6/1996 Uehara et al. ..... 156/539
6,508,901 B2 * 1/2003 Miller et al. ..... 156/227

* cited by examiner

*Primary Examiner*—James Sells
(74) *Attorney, Agent, or Firm*—Gerald K. Kita; Blake T. Biederman

(57) ABSTRACT

A polishing pad installation tool comprised of a base portion and at least one compressible layer in operative connection with the base portion. The compressible layer includes a plurality of apertures through an upper surface of the compressible layer. The tool further includes a plurality of parallel pins extending outwardly from the base portion through the apertures of the compressible layer. Each of the pins includes a collar portion in surrounding relation about each pin. When the compressible layer is in an uncompressed condition, the collar portions are beneath the upper surface of the compressible layer. The pins are positioned on the base portion in a pattern which corresponds to the holes in the polishing platen. The pins have diameters which are smaller than the diameters of the holes in a polishing pad. The collars have diameters larger than the diameters of the holes in the polishing pad. As the pins of the tool enter the holes of the polishing pad, the compressible layer of the tool compresses against the polishing surface of the pad to adhesively bond the polishing pad to the polishing platen. The collar portions of the pins are operative to press against the edges of the holes of the polishing pad to seal the hole edges adjacent the polishing platen.

22 Claims, 2 Drawing Sheets

POLISHING PAD INSTALLATION TOOL

CROSS REFERENCE TO RELATED APPLICATION

This application claims the benefit of provisional application Ser. No. 60/257,076 filed Dec. 21, 2000.

FIELD OF THE INVENTION

This invention relates to chemical mechanical polishing systems. Specifically this invention relates to a tool for installing a polishing pad to a polishing fixture.

BACKGROUND OF THE INVENTION

Integrated circuits are often fabricated from semiconductor wafers. The surfaces of semiconductor wafers are finely polished and planarized using chemical mechanical polishing (CMP) processes. Many of these polishing processes use a polishing fixture that includes a disk-shaped polishing platen. The polishing platen of a polishing fixture is operative to accept one or more polishing pads that are adhesively bonded to the planar surfaces of the platen. When a substrate such as a semiconductor wafer is placed adjacent the polishing fixture, the polishing pad is operative to polish and planarize the surface of the wafer.

Polishing pads include an adhesive layer. The adhesive layer is comprised of a pressure sensitive adhesive (PSA) that is operative to adhere the polishing pad to the platen of the polishing fixture. Polishing pads are manufactured with a protective release liner that overlies the adhesive layer of the polishing pad. The release liner is typically comprised of a flexible plastic planar membrane which must be peeled away from the adhesive layer prior to mounting the polishing pad to a polishing fixture.

To avoid producing aberrations in the surface of a wafer and to prolong the operational lifetime of a polishing pad, the polishing pad must be installed on the platen without pockets of trapped air. In prior art installations of a polishing pad, air pockets are removed by rolling a roller over the pad. Polishing pads often include a plurality of channels in their adhesive layers which enable trapped air to escape as the roller is rolled over the pad. Unfortunately, rollers are often unable to produce a uniform bond between the entire adhesive layer of the pad and the platen. In those areas where the adhesive bond is weak, the pad may delaminate from the platen. Such pad delamination can produce waves or bubbles in the pad which may produce aberrations in the surface of a wafer. Consequently, there exists a need for a pad installation tool which is operative to uniformly bond the adhesive layer of a polishing pad to a polishing fixture.

Polishing fixtures may include slurry and blow off holes in their platens which direct slurry and gasses to the surface of a wafer being planarized and polished. The polishing pads for these types of platens include corresponding holes through the polishing pad. Such pads when installed on the platen must be properly aligned to achieve proper registration between the holes of the platen and pad. In addition the adhesive of the pad around the holes must be uniformly sealed to prevent slurry from gradually "wicking" between the polishing pad and platen. Slurry underneath a pad will attack the adhesive layer of the pad, resulting in bubbles and eventual delamination of the pad from the polishing fixture.

Unfortunately, the process of using a roller to install a pad on a platen with slurry and blow off holes often does not achieve a uniform adhesive bond around the holes of the platen. Consequently, there exists a need for a process of installing polishing pads which are operative to produce a uniform adhesive seal around the slurry and blow-off holes of a polishing fixture platen.

SUMMARY OF THE INVENTION

It is an object of the present invention to provide a tool for installing a polishing pad to a polishing fixture.

It is a further object of the present invention to provide a polishing pad installation tool that removes air pockets from between a polishing pad and a polishing fixture.

It is a further object of the present invention to provide a polishing pad installation tool that produces a uniform adhesive bond between a polishing pad and a polishing fixture.

It is a further object of the present invention to provide a polishing pad installation tool that produces a tight adhesive seal around slurry and blow holes of a polishing fixture platen.

Further objects of the present invention will be made apparent in the following Best Modes for Carrying Out Invention and the appended claims. Embodiments of the invention will now be described with reference to the accompanying drawings.

DETAILED DESCRIPTION

Figure 2:
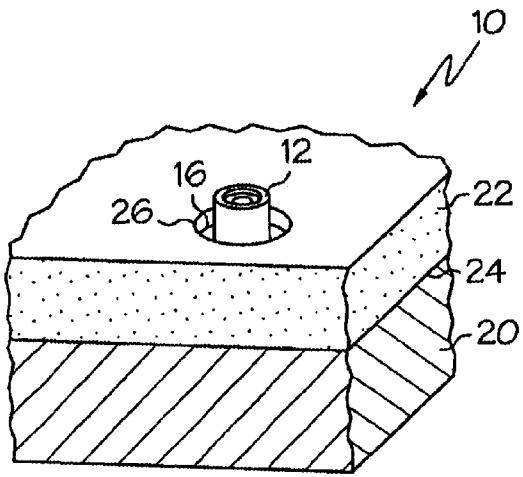
FIG. 2 is a perspective view representative of the exemplary polishing pad installation tool.

The foregoing objects are accomplished in one exemplary embodiment of the invention by a polishing pad installation tool that includes a compressible foam layer with a shape that corresponds to the shape of a polishing pad. The foam layer is supported by a rigid base portion. The base portion includes a plurality of parallel pins which extend outwardly from the tool body and protrude through the foam layer. The exemplary pins are aligned in a pattern which corresponds to the holes in a polishing fixture platen.

In the exemplary embodiment of the present invention the pins are encircled by collars which have a diameter greater than the diameter of the platen holes. The exemplary collars are operative to slide along their respective pins between a lower position and an upper position and are biased to move to the upper position. In the exemplary embodiment, when the foam layer is uncompressed and the collar is in the upper position, the collar is lower in height than the upper surface of the foam layer with respect to the tool base. In an alternative embodiment, the collars may be rigidly fixed to the tool body in a position that is lower in height than the upper surface of the uncompressed foam layer.

To assist an operator in aligning the tool with a polishing pad and polishing fixture, the exemplary tool includes at least one king pin that is visually distinguishable from the remaining pins. In the exemplary embodiment the tool includes two king pins which are longer in length than the other pins. Exemplary king pins may also have a different coloring than other pins. The exemplary king pins help the operator center the exemplary tool to achieve proper registration of the tool pins with the holes of the polishing pad and/or polishing platen.

When the exemplary tool is properly positioned with at least the king pins projecting into the holes of the pad and/or platen, the tool is pressed against the top surface of the polishing pad. As pressure is applied to the tool, the foam layer of the tool is operative to compress adjacent the polishing pad. The pressure of the foam layer is operative to remove air pockets by forcing air out from between the polishing pad and the polishing platen. The pressure of the foam layer further causes the adhesive backing on the pad to bond to the polishing platen.

As the foam layer of the tool is compressed the collars around the pins come in contact with portions of the polishing pad around the holes in the pad. As further pressure on the tool is applied, the collars are operative to concentrate pressure on the hole edges to tightly seal the polishing pad to the polishing platen around each slurry and blow-off hole. In the exemplary embodiment the collars are biased with springs encircling the pins between the base of the tool and the collars. In the exemplary embodiment the springs biasing the collars have a greater resistance to compression than the foam at the point when the collars contact the polishing pad.

The exemplary polishing pad installation tool may further be adapted for use with a double sided polisher by including a second foam layer on the tool body opposed from the first foam layer. As the platens are moved together the tool is operative to install a polishing pad to each of the platens of the double sided polisher.

Figure 1:
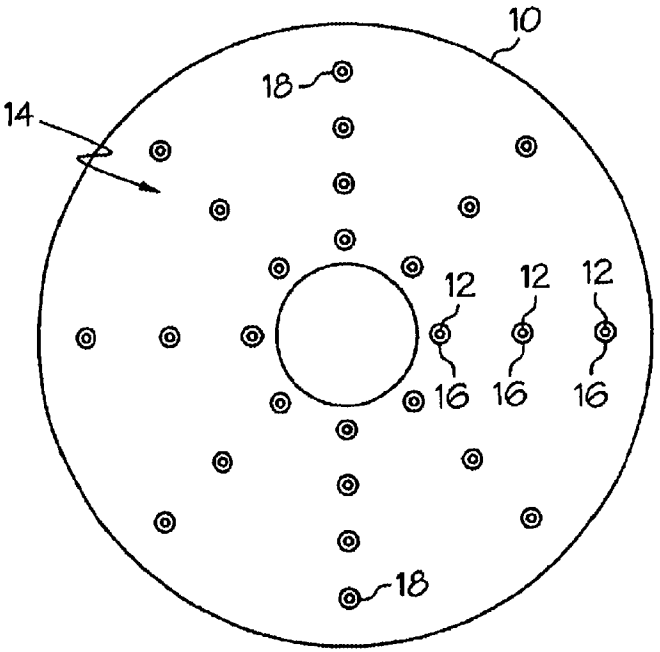
FIG. 1 is a top plan view representative of an exemplary polishing pad installation tool of the present invention.

Referring now to the drawings and particularly to FIG. 1, there is shown therein a top plan view representative of an exemplary polishing pad installation tool 10 of the present invention. The tool 10 includes a plurality of parallel pins 12 that are positioned in a pattern 14 which corresponds to the holes in a polishing platen of a polishing fixture. Examples of polishing platen holes include slurry holes and blow off holes which direct slurry and gases to the surface of a wafer being polished and planarized by the polishing fixture. In the exemplary embodiment, each of the pins 12 include a collar 16 in surrounding relation about each pin.

FIG. 2 shows a perspective view of a portion of the polishing tool 10 showing one pin 12. The polishing tool includes a base portion 20 and at least one compressible layer 22 in operative connection with at least one side 24 of the base portion 20. The exemplary compressible layer is comprised of a resiliently deformable material such as a high density foam. The compressible layer includes a plurality of apertures 26. Each pin 10 extends from the base portion 20 through each aperture 26 of the compressible layer.

Figure 3:
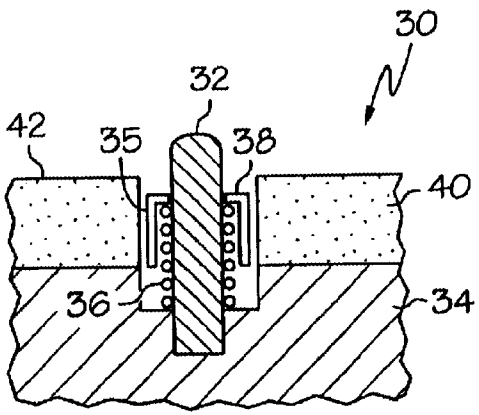
FIG. 3 is a cross-sectional side view representative of the exemplary polishing pad installation tool.

FIG. 3 shows a side cross-sectional view of one exemplary embodiment of the tool 30. Here each pin 32 is integrally mounted to the base portion 34 of the tool. A collar 35 surrounds each pin 32 and is operative to slide along the pin. In this described exemplary embodiment, the collar 35 is biased to slide upwardly away from the base portion 34 with a biasing element such as spring 36. Prior to using the tool to install a polishing pad to a polishing platen the compressible layer 40 of the tool is in an uncompressed condition. When the compressible layer 40 is in the uncompressed condition, an upper surface 38 of the exemplary collar 34 is positioned below the upper surface 42 of the compressible layer 40.

Figure 4:
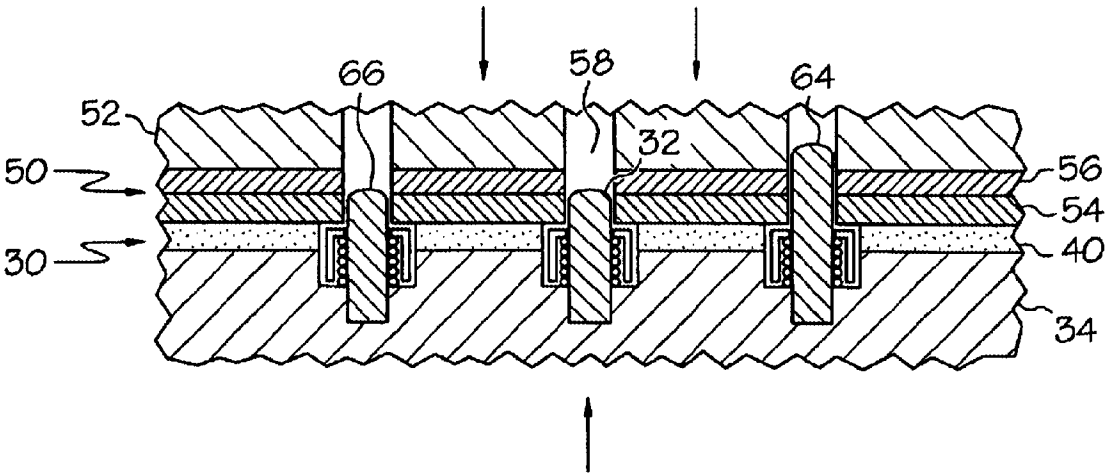
FIGS. 4–5 cross-sectional side views representative of the exemplary polishing pad installation tool being used to install a polishing pad on a polishing fixture.

FIG. 4 shows the exemplary tool 30 positioned for mounting a polishing pad 50 to a polishing platen 52. The exemplary polishing pad 50 includes a polishing surface 54 and a pressure sensitive adhesive (PSA) layer 56. The exemplary tool 30 is operative to press the polishing pad 50 against the polishing platen 52. When this occurs the pins 32 are operative to enter the holes 58 of the polishing pad 50 and the compressible layer 40 is operative to compress. As the compressible layer compresses, air between the polishing pad and the polishing platen is forced out through channels in the adhesive layer. When sufficient pressure is applied against the polishing pad by the tool, the adhesive layer 54 is operative to bond with the platen 52.

Figure 5:
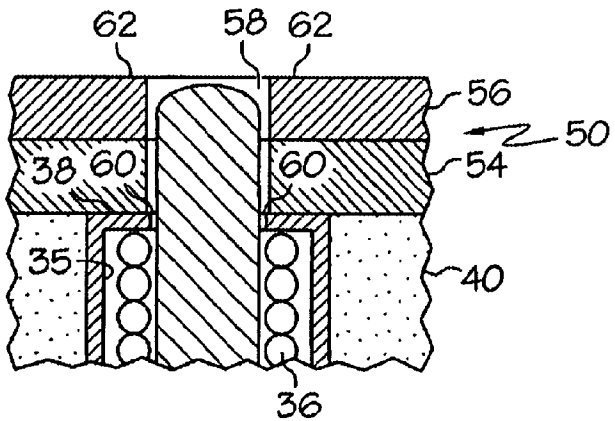

As shown in FIG. 5, the diameter of the collar 38 is greater than the diameter of the polishing pad hole 58. When the compressible layer 40 compresses, the upper surface 38 of the collar 35 is operative to contact the polishing pad edges 60 which surround the holes 58 in the polishing pad 50. As the tool is further urged against the polishing pad 50, the upper surface 38 of the collar 35 focuses pressure on the hole edges 60 so as to have the portions 62 of the adhesive 56 surrounding the hole 58 create a tight adhesive seal with the platen. In the exemplary embodiment the spring 36 has a greater resistance to compression then the compressible layer 40 at the point when the collar 35 contacts the polishing pad 50. Also in the exemplary embodiment the height of the upper surface of the compressible layer when the compressible layer is uncompressed is greater than or equal to the height of the upper surface 38 of the collar. Thus the compressible layer 40 must compress a small amount before the upper surface 38 of the collar contacts the polishing pad 50.

Figure 6:
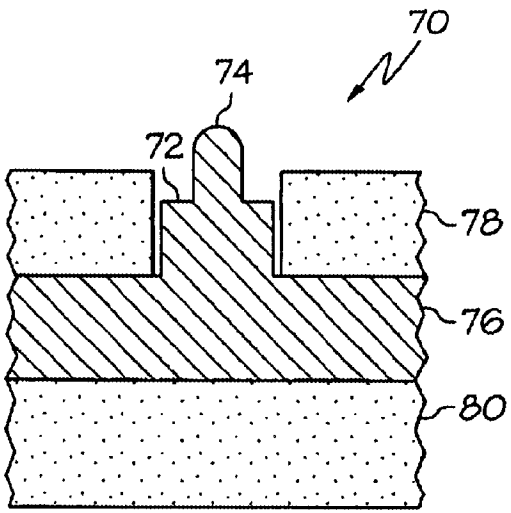
FIG. 6 is a cross-sectional side view representative of an alternative exemplary embodiment of the polishing pad installation tool.

FIG. 6 shows a cross-sectional side view of an alternative embodiment of the tool 70. Here the collar 72 is integral with the pin 74 and is not operative to slide along the pin. In addition, the base portion 76 of the tool 70 includes two opposed compressible layers 78, 80 on each side of the base portion 76. The two opposed compressible layers enable the exemplary tool 70 to simultaneously install two polishing pads on opposed polishing platens of a double sided polisher.

For example, a bottom polishing pad may be installed on the lower platen of a double sided polisher by smoothing the pad onto the bottom platen while simultaneously removing the release liner. The exemplary tool with opposed compressible layers may then be placed on top of the bottom pad and aligned with the top platen. An upper pad may then be placed onto the tool with the polishing surface of the pad face down on the top compressible layer of the tool. The release liner may then be removed from the upper pad and the upper platen may then be lowered onto the tool. The pins of the tool are operative to ensure proper alignment and sealing of the polishing pads around the slurry holes of the polishing fixture. The upper and lower compressible layers of the tool are operative to remove air pockets and bond the adhesive layers of the pads to their respective polishing platens. In addition to the exemplary embodiment shown in FIG. 6, the exemplary embodiments of the invention shown in FIGS. 1–5 may also include two opposed compressible layers.

In the exemplary embodiment of the present invention, at least one of the pins is distinguished from the remaining pins by one or more visual characteristics such as length, color or visual graphics adjacent the pin. The distinguished pin is operative as a king pin which may be used to assist an operator with the task of aligning a polishing platen with the tool. FIG. 4, shows an exemplary king pin 64 which is longer than the other pins 32, 66. FIG. 1 shows one exemplary embodiment of the present invention where the tool 10 includes two king pins 18 adjacent opposed edges of the tool. In the exemplary embodiment all of the pins extend above the upper surface of the compressible layer when the compressible layer is uncompressed. However, in alternative embodiments, only the king pins may extend above the upper surface of the compressible layer, when the compressible layer is uncompressed.

In the exemplary embodiment the base portion is comprised of a durable plastic such as HDPE. However, alternative exemplary embodiments may be comprised of any material that is operative to rigidly support the pins. In the exemplary embodiment the pins may also be comprised of a durable plastic such as HDPE and may be formed integral with the base portion. In alternative embodiments the pins may be comprised of other durable materials such as a stainless steel and may also be screwed into the base portion. In the exemplary embodiment the collars are at least ⅛th of an inch greater in diameter than the pins. In alternative embodiments other collar diameters may be used which are operative to sufficiently overlap the edges of the polishing pad holes to provide a concentration of pressure for sealing the edges of the polishing pad holes.

Thus the polishing pad installation tool achieves the above stated objectives, eliminates difficulties encountered in the use of prior devices and systems, solves problems and attains the desirable results described herein.

In the foregoing description certain terms have been used for brevity, clarity and understanding, however no unnecessary limitations are to be implied therefrom because such terms are used for descriptive purposes and are intended to be broadly construed. Moreover, the descriptions and illustrations herein are by way of examples and the invention is not limited to the exact details shown and described.

In the following claims any feature described as a means for performing a function shall be construed as encompassing any means known to those skilled in the art to be capable of performing the recited function, and shall not be limited to the structures shown herein or mere equivalents thereof.

Having described the features, discoveries and principles of the invention, the manner in which it is constructed and operated, and the advantages and useful results attained; the new and useful structures, devices, elements, arrangements, parts, combinations, systems, equipment, operations, methods and relationships are set forth in the appended claims.

What is claimed is:

1. A polishing pad installation tool comprising:

a base portion;

at least one compressible layer in operative connection with the base portion, wherein the compressible layer includes an upper surface, and wherein the compressible layer includes a plurality of apertures through the upper surface of the compressible layer;

a plurality of parallel pins in operative connection with the base portion, wherein the pins extend outwardly through the apertures of the compressible layer, wherein each pin includes a collar portion in surrounding relation about each pin, wherein when the compressible layer is in an uncompressed condition, the collar portions of each pin do not extend above the upper surface of the compressible layer.

2. The polishing pad installation tool according to claim 1, wherein the pins are positioned on the base in a pattern which corresponds to the holes in a polishing platen.

3. The polishing pad installation tool according to claim 2, wherein the pins have diameters which are smaller than the diameters of the holes in a polishing pad.

4. The polishing pad installation tool according to claim 3, wherein the collar portions of each pin have diameters larger than the diameters of the holes in the polishing pad.

5. The polishing pad installation tool according to claim 4, wherein when the tool is placed adjacent the polishing pad the pins are operative to enter each of the holes of the polishing pad.

6. The polishing pad installation tool according to claim 5, wherein at least two of the pins are king pins, and wherein the king pins are visually distinguishable from the pins that are not the king pins.

7. The polishing pad installation tool according to claim 6, wherein the king pins are longer than the pins that are not king pins with respect to the base portion.

8. The polishing pad installation tool according to claim 7, wherein when the compressible layer is in the uncompressed condition, the king pins extend above the upper surface of the compressed layer.

9. The polishing pad installation tool according to claim 5, wherein when the tool is pressed against the polishing pad the compressible layer is operative to compress between the base portion and a polishing surface of the polishing pad.

10. The polishing pad installation tool according to claim 5, wherein the collar portion of each pin includes an upper surface, wherein each pin extends above the collar portion.

11. The polishing pad installation tool according to claim 10, wherein when the compressible layer is in the uncompressed condition, the upper surface of each collar portion is lower in height with respect to the base portion than the upper surface of the compressible layer.

12. The polishing pad installation tool according to claim 5, wherein the collar portions are in sliding connection with the pins, and wherein the collar portions are biased to slide upwardly along the pins and away from the base portion.

13. The polishing pad installation tool according to claim 12, further comprising springs in surrounding relation about the pins, wherein the springs are operative to bias the collar portions.

14. The polishing pad installation tool according to claim 13, wherein when the collar portions of the pins contact the polishing pad, the springs have a greater resistance to compression than the compressible layer.

15. The polishing pad installation tool according to claim 5, wherein the upper surface of the compressible layer is generally planar.

16. The polishing pad installation tool according to claim 15, wherein the compressible layer includes a resilient high density foam.

17. The polishing pad installation tool according to claim 5, further comprising a second compressible layer in operative connection with the base portion opposed from the first compressible layer.

18. A method of installing a polishing pad on a polishing platen comprising:

a) placing a first polishing pad between a first polishing platen and a first side of a polishing tool, wherein the adhesive layer of the first polishing pad is adjacent the first polishing platen;

b) placing a plurality of pins of the polishing tool into a plurality of holes in the first polishing pad, wherein each of the pins of the polishing tool includes a collar portion;

c) adhesively bonding the first polishing pad to the first polishing platen, including pressing the first side of the polishing tool against the first polishing pad; and d) adhesively sealing a plurality of edges of the holes in the first polishing pad to the first polishing platen, including pressing the collar portions of each of the pins adjacent the hole edges of the first polishing pad.

19. The method according to claim 18, wherein step (c) includes forcing air out from between the first polishing pad and the first polishing platen, and compressing a first compressible layer of the first side of the polishing tool adjacent a first polishing surface of the first polishing pad.

20. The method according to claim 19, wherein prior to step (c) further comprising:

placing a second polishing pad between a second polishing platen and a second side of the polishing tool that is opposed from the first side of the polishing tool, wherein the adhesive layer of the second polishing pad is adjacent the second polishing platen; and wherein step (c) includes adhesively bonding the second polishing pad to the second polishing platen, including pressing the second side of the polishing tool against the second polishing pad.

21. The method according to claim 20, wherein step (c) includes decreasing the distance between the first and second polishing platens.

22. The method according to claim 18, further comprising:

aligning at least one pin of the polishing tool with at least one hole in the first polishing platen.

* * * * *